US006070594A

United States Patent [19]

Mears

[11] Patent Number: 6,070,594

[45] Date of Patent: Jun. 6, 2000

[54] BRUSH WITH RETRACTABLE BRISTLES

[75] Inventor: Christopher Mears, New York, N.Y.

[73] Assignee: Arich, Inc., New York, N.Y.

[21] Appl. No.: 09/031,077

[22] Filed: Feb. 25, 1998

[51] Int. Cl.[7] ..... A45D 24/10; A46B 7/00

[52] U.S. Cl. ..... 132/123; 132/271; 15/184; 15/203; 219/222

[58] Field of Search ..... 15/184, 185, 201, 15/203, 169; 132/120, 121, 122, 123, 271, 119; 219/222

[56] References Cited

U.S. PATENT DOCUMENTS

| | | | |
|---|---|---|---|
| 2,244,068 | 6/1941 | Kay | 132/123 |
| 3,962,742 | 6/1976 | Vendur | 15/201 |
| 4,001,910 | 1/1977 | Peilet | 15/184 |
| 4,162,554 | 7/1979 | Peilet | 15/184 |
| 4,214,340 | 7/1980 | Youngberg et al. | 15/184 |
| 4,323,085 | 4/1982 | Röhm | 132/113 |
| 4,327,753 | 5/1982 | Bertschi | 132/123 X |
| 4,335,732 | 6/1982 | Megna | 132/123 |
| 4,411,281 | 10/1983 | Doern | 132/229 |
| 4,467,821 | 8/1984 | Stewart | 132/123 |
| 4,492,241 | 1/1985 | Thaler et al. | 132/229 |
| 5,449,006 | 9/1995 | Hogan et al. | 132/112 |

FOREIGN PATENT DOCUMENTS

| | | | |
|---|---|---|---|
| 168099 | 1/1986 | European Pat. Off. | 132/271 |
| 3242743 | 7/1984 | Germany | 219/222 |

*Primary Examiner*—Mark Spisich
*Attorney, Agent, or Firm*—Venable; Michael A. Gollin

[57] ABSTRACT

A retractable brush for brushing, cleaning and curling hair comprises an outer tubular member having a pattern of bristle apertures, and an inner tubular member extending lengthwise within the outer tubular member and being mounted to undergo angular displacement in opposite directions within the outer tubular member. A plurality of bristle supports each extend lengthwise within the outer tubular member and support a series of bristles. The bristle supports have opposite end portions turnably mounted on flanges on the inner tubular member to undergo angular displacement in forward and reverse directions to effect extension and retraction of the bristles through the bristle apertures of the outer tubular member in response to angular displacement of the inner tubular member. A handle is connected to the outer tubular member for grasping by a hand of a user of the brush, and an actuator is manually turnably mounted on the handle and connected to the inner tubular member to enable the user to angularly displace the inner tubular member in opposite directions to extend and retract the bristles in response to manual turning of the actuator.

18 Claims, 4 Drawing Sheets

BRUSH WITH RETRACTABLE BRISTLES

FIELD OF THE INVENTION

The present invention relates generally to a brush, and, more particularly, to a brush having extendable and retractable bristles for styling, curling and drying hair, or for general cleaning purposes.

BACKGROUND INFORMATION

The present invention relates to a brush for human, animal, or synthetic hair. A brush according to the present invention can also be used as a cleaning device having retractable bristles for general cleaning purposes.

A conventional curling brush has a shaft having a round cross section. One portion of the shaft is used as a handle, and another portion of the shaft is provided with spaced holes in which bristles are mounted. When such a conventional curling brush is used for hair styling, it is necessary to unwind the brush to remove it from the hair. This procedure often causes tangling, pulling, and damage to the hair. There are several known non-tangling curling brushes that overcome this problem. One such brush includes a handle portion that is freely rotatable with respect to the brush portion when a lock member is disengaged.

Another type of brush designed to overcome the aforementioned problems is provided with retractable bristles. However, most of the prior art retractable brushes require a two-step controlling method to retract the bristles, which involves the sliding of a control element and the subsequent pressing of the control element, such as disclosed in U.S. Pat. No. 4,226,251 to Wall, for example.

Some known retractable brushes incorporate a horizontal control element which, when actuated, causes the bristles to retract. One such brush is disclosed in U.S. Pat. Nos. 4,191,200 and 4,596,261 to Renda. The necessary horizontal movement is difficult, however, due to the awkward combination of direct pressure and simultaneous sliding movement required to operate the control element with the thumb.

Some retractable brushes are provided with several control knobs that require two-hand operation, one hand to hold the brush and the other to turn/push the knob(s). See, for example, U.S. Pat. No. 4,411,281 to Doern and U.S. Pat. No. 4,492,241 to Thaler et al. This method is impractical for many purposes, such as curling during the blow drying process, wherein the user would either need to have a third hand, or be required to put the dryer down to adjust the knob(s).

U.S. Pat. No. 4,567,905 to Stewart et al. discloses a slidable control for use in retractable bristle brushes. The control operates by coaction with a rotatable cylindrical mandrel carrying pivoted bristles. The control includes a longitudinally slidable button in the handle which has a control. U.S. Pat. No. 4,001,910 to Pellet also discloses retractable brushes of the general type having bristles which can be retracted into the casing of the brush or extended outwardly from the casing into positions at which the bristles are used. These brushes, however, require a great many parts and complex assembly procedures and are therefore not practical.

SUMMARY OF THE INVENTION

In view of the foregoing disadvantages of the prior art, an object of the present invention is to provide an improved brush having bristles which are extendable and retractable in a one-step operation and which is capable of brushing and curling the hair, or for cleaning a surface. Preferably, all of the above-described functions should be controllable in a single motion requiring the use of only one hand or finger, without the need for awkward finger motion or positioning.

A further object of the present invention is to provide a brush having extendable and retractable bristles and which is simple and inexpensive to manufacture, durable in construction, and efficient in performing the above-described functions.

Another object of the present invention is to provide a brush, such as a curling brush, having extendable and retractable bristles and which may be used in cooperation with a hair drying apparatus, wherein the brush has means for conveying hot air from a heating element to a user's hair.

Yet another object of the present invention is to provide a brush having extendable and retractable bristles and which may be used in cooperation with a hair curling apparatus, wherein the brush has means for conveying heat from an internal heating element to the user's hair.

Still yet another object of the present invention is to provide a brush with extendable and retractable bristles which retract into the body of the brush, thereby providing for easy removal of hair and other debris from the bristles and convenient storage of the brush.

The foregoing objects as well as others which will be readily apparent to those of ordinary skill in the art upon a reading of this disclosure, are attained by the inventive brush which has extendable and retractable bristles for brushing the hair, curling the hair, and general cleaning. The brush has an outer tubular member having a pattern of bristle apertures and an inner tubular member extending lengthwise within the outer tubular member and being mounted to undergo angular displacement in opposite directions within the outer tubular member, the inner tubular member having a pair of axially spaced flanges. A plurality of bristle supports extend lengthwise within the outer tubular member and support a row of bristles. The bristle supports have opposite end portions turnably mounted on the flanges to undergo angular displacement in forward and reverse directions to effect extension and retraction of the bristles through bristle apertures in the outer tubular member in response to angular displacement of the inner tubular member. A handle is connected to one of the inner tubular member and the outer tubular member for grasping by a hand of a user of the brush, and an actuator is manually turnably mounted on the handle and connected to the inner tubular member to enable the user to angularly displace the inner tubular member in opposite directions to extend and retract the bristles in response to manual turning of the actuator.

Support means are provided for supporting the inner and outer tubular members for relative angular displacement. The support means preferably comprises an end cap covering a first axial end of the inner and outer tubular members. The end cap has a recess in which one end of the outer tubular member is fixedly engaged and has a hub which extends into and rotatably supports thereon one end of the inner tubular member to permit the inner tubular member, but not the outer tubular member, to undergo angular displacement in opposite directions relative to the hub.

Locking means is disposed at a second axial end of the inner and outer tubular members for releasably locking the inner tubular member in angular positions corresponding to full extension and full retraction of the bristles. The locking means preferably comprises an end piece fixed to the outer tubular member for rotation therewith relative to the inner tubular member and provided with one or more recesses which receive a spring-biased detent for releasably locking the inner tubular member in predetermined angular positions when the actuator has been manually turned to positions corresponding to full extension and retraction of the bristles.

The handle is preferably mounted to pass through the inside of the inner tubular member and is fixedly engaged to the hub of the end cap.

The manually turnable actuator is preferably in the form of a knob encircling a grip portion of the handle and being angularly displaceable relative thereto by use of a single one of the user's finger. The actuator is preferably provided with an inner hub encircling the handle and being angularly displaceable thereon and being fixedly connected to the inner tubular member to undergo angular displacement therewith. By turning the actuator in a first direction, the inner tubular member likewise undergoes angular displacement in the first direction, thereby forcing the bristles against the respective walls of the bristle apertures in the outer tubular member to cause the bristle supports to undergo angular displacement on the flanges of the inner tubular member in a second direction, opposite to the first direction, to extend the bristles through the bristle apertures. When the actuator is turned in the opposite or second direction, the inner tubular member undergoes angular displacement in the second direction, causing the bristle supports to angularly displace in the first direction to retract the bristles through the bristle apertures.

Ease of manufacturing and assembly is achieved by turnably mounting the ends of the bristle supports in openings in the flanges disposed at opposite axial ends of the inner tubular member, thereby avoiding the need for complex structure requiring a series of bristle supports formed in or on the inner tubular member, and avoiding the complicated assembly procedures required in prior art retractable brushes. Moreover, by virtue of this construction, the inner tubular member may be provided with air openings to convey hot air produced by a heating element to the user's hair.

In order to further simplify manufacturing and assembly of the brush, the outer tubular member preferably comprises a series of interconnected arc-shaped members arranged to form a cylindrical housing and having lips at both axial ends thereof which extend into complementary parts of the end cap and end piece.

Most preferably, the bristle supports have a circular cross section and the flanges are provided with cutouts or openings having a similar shape sufficient to accommodate and retain the respective bristle supports and to permit the bristle supports to undergo turning angular displacement in forward and reverse directions within the cutouts in response to angular displacement of the inner tubular member to effect the extension and retraction of the bristles through the corresponding apertures provided in the outer tubular member.

In another preferred embodiment, a brush having extendable and retractable bristles is provided for attachment to a hair dryer for use in styling the hair. The brush has an outer tubular member having a pattern of bristle apertures and an inner tubular member extending lengthwise within the outer tubular member and being mounted to undergo angular displacement in opposite directions within the outer tubular member, the inner tubular member having a pair of axially spaced flanges and a plurality of air openings extending either circumferentially or lengthwise thereof for conveying hot air. A plurality of bristle supports extend lengthwise within the outer tubular member and support a row of bristles. The bristle supports have opposite end portions turnably mounted on the flanges to undergo angular displacement in forward and reverse directions to effect extension and retraction of the bristles through bristle apertures in the outer tubular member in response to angular displacement of the inner tubular member. A manually turnable actuator is mounted on the inner tubular member to enable the user to angularly displace the inner tubular member in opposite directions to extend and retract the bristles in response to manual turning of the actuator. The actuator is rotatably connected to a connecting sleeve in which an outlet nozzle of a hair dryer may be received such that hot air output by the hair dryer is directed through the central opening of the actuator, through the circumferential or lengthwise air openings of the inner tubular member, and through the bristle apertures in the outer tubular member to dry the user's hair.

BRIEF DESCRIPTION OF THE DRAWINGS

Aspects of the present invention will now be described by way of example only with reference to the accompanying drawings in which.

DETAILED DESCRIPTION OF THE PREFERRED EMBODIMENTS

Figure 1:
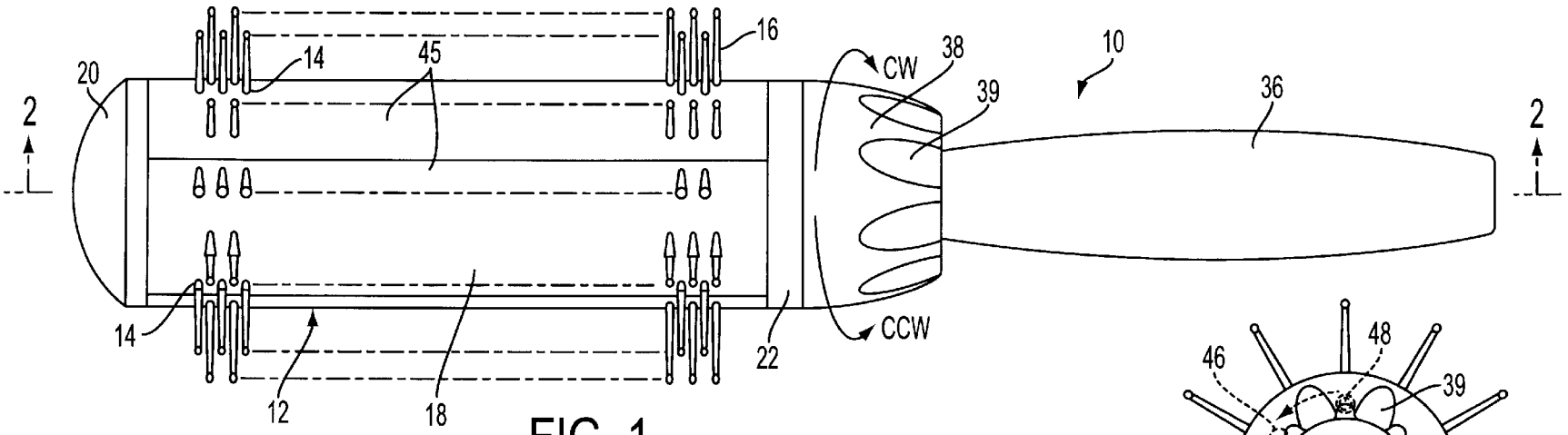
FIG. 1 is a lengthwise side elevational view of a retractable brush in accordance with a first embodiment of the present invention.

Preferred embodiments of the present invention will now be described by way of example with reference to the drawings. While the inventive brush has many applications, the preferred embodiments thereof will be described with reference to a hair curling brush.

As shown in FIGS. 1–4, and by way of example only, a retractable brush generally indicated by reference numeral 10 comprises a cylindrical housing 12 having a pattern of bristle apertures 14 therein through which a plurality of bristles 16 are extendable and retractable. The cylindrical housing 12 comprises an outer tubular member 18 having an end cap 20 at one axial end thereof and an end piece 22 at the other axial end thereof. A cylindrical bristle mounting member comprising an inner tubular member 24 having a smaller diameter than that of the outer tubular member 18 is turnably disposed within the outer tubular member 18 so as to be angularly displaceable in forward and reverse directions with respect to the outer tubular member 18.

Figure 4:
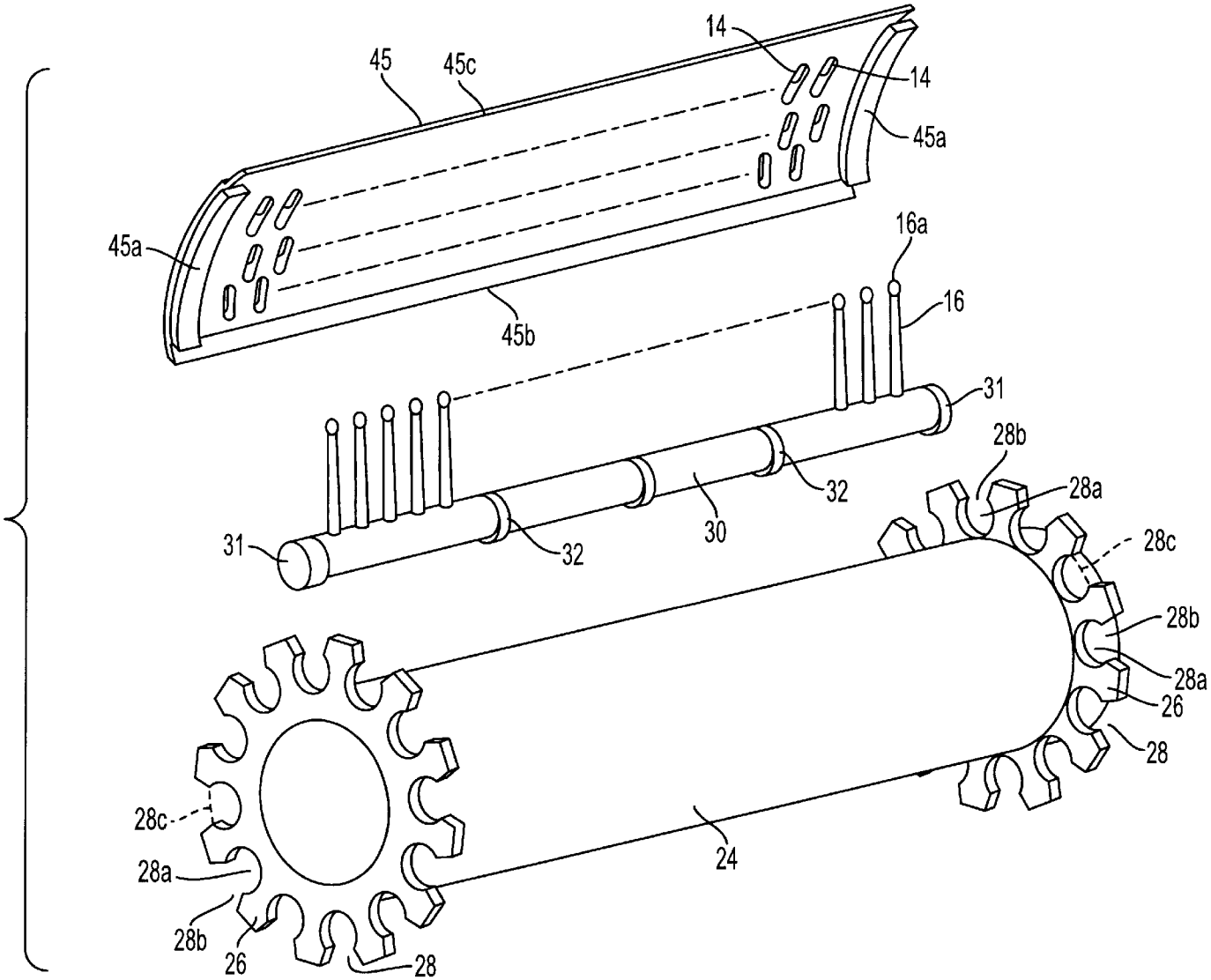
FIG. 4 is a partially exploded view of the cylindrical housing of the brush shown in FIG. 1, illustrating the inner tubular member, a bristle support and a segment of the outer tubular member of the brush shown in FIG. 1.

The inner tubular member 24 extends lengthwise within the outer tubular member 18 and is provided with axially spaced flanges 26 proximate each end thereof. As shown in FIG. 4, each of the flanges 26 has a set of circumferentially spaced-apart cutouts or openings 28 for turnably supporting one end of a set of bristle supports 30. The openings 28 each have a region 28*a* of partly circular shape and a region 28*b* of outwardly diverging shape, and the imaginary interface 28*c* between the two regions 28*a* and 28*b* is smaller in dimension than the diameter of the ends 31 of the bristle supports 30. In this manner, the bristle supports 30 can be easily mounted to the inner tubular member 24 by moving the bristle supports radially inwardly and snapping the ends 31 thereof into oppositely aligned openings 28 of the flanges 26. The ends 31 of the bristle supports 30 are dimensioned to fit loosely within the openings 28 so that the bristle supports may turn freely within the openings. By this construction, the bristle supports 30 are pivotally supported by the inner tubular member 24 to undergo angular displacement within the openings 28. Alternatively, the flanges may be provided with completely circular openings, and the ends 31 of the bristle supports 30 can be inserted axially into the circular openings. The bristle supports 30 are preferably provided with axially spaced and circumferentially extending ribs 32 which ride on the surface of the inner tubular member 24 to prevent the bristle supports 30 from bending or bowing when the brush is in use. The ribs 32 extend circumferentially around at least a portion of the bristle supports 30 and facilitate smooth angular displacement of the bristle supports in the openings 28 in response to turning of the inner tubular member 24 relative to the outer tubular member 18.

A handle 34 is extends lengthwise through the interior of the inner tubular member 24. One end of the handle 34 has a grip portion 36 which is designed to be held by the user, and the other end of the handle 34 is fixedly secured in a hub 20*a* of the end cap 20.

Figure 3:
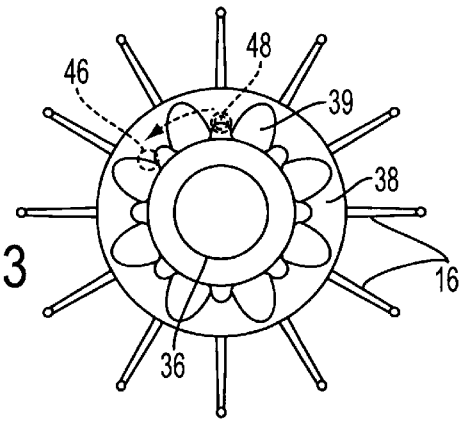
FIG. 3 is an end elevational view of the retractable brush shown in FIG. 1 as seen from the handle end of the brush.
Figure 2:
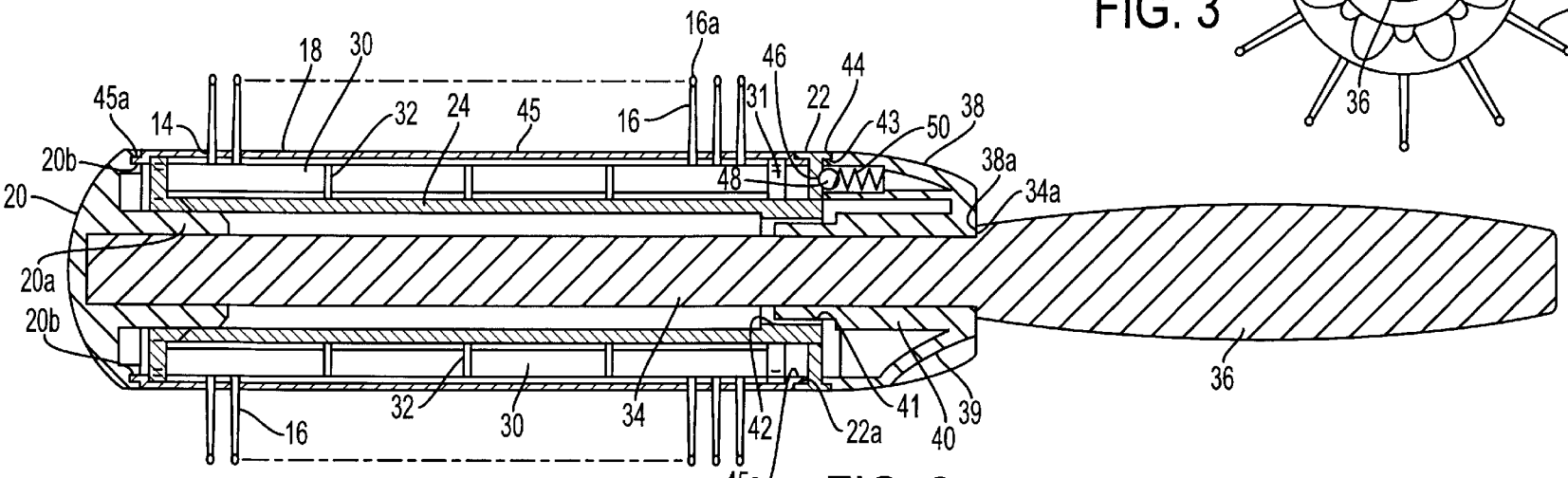
FIG. 2 is a sectional view of the retractable brush of the first embodiment taken along line 2—2 of FIG. 1.

A manually turnable actuator 38 for angularly turning the inner tubular member 24 is turnably mounted on the handle 34 directly adjacent the cylindrical housing 12. As shown in FIGS. 1–3, the actuator 38 is preferably in the form of a knob having circumferentially spaced-apart depressions 39 to facilitate turning of the knob by a single finger of the user. The knob 38 has a central hub portion 40 through which extends, in slidable fashion, the handle 34. As best seen in FIG. 2, an end face 38*a* of the actuator 38 slidingly abuts an annular surface 34*a* of the handle 34, which limits the extent of axial travel of the actuator 38 and housing 12 during assembly. The hub 40 has a pair of diametrically opposed axial slots 41 in which are received axially extending projections 42 of the inner tubular member 24. By means of this projection-and-slot connection, the inner tubular member 24 is rotationally locked with the knob 38 so that turning of the knob in either direction effects a corresponding turning of the inner tubular member 24. The knob 38 is slidably engaged with the end piece 22 through a peripheral recess 43 extending around the end wall of the knob 38 and in which is received an annular lip 44 of the end piece 22. Due to this sliding connection, the knob 38 can turn relative to the brush housing 12 to angularly displace the inner tubular member 24 in one direction with respect to the outer tubular member 18 to extend the bristles 16 from the outer tubular member 18 and to angularly displace the inner tubular member 24 in the other direction to withdraw the bristles 16 into the outer tubular member 18 for the purpose of cleaning the bristles, untangling the hair, or for storage.

The cylindrical housing 12 of the brush 10 is formed of a plurality of curved sidewall sections 45 held together by the end cap 20 and the end piece 22 so as form a cylindrical chamber or hollow compartment in which are disposed the inner tubular member 24, bristle supports 30 and reciprocally movable bristles 16. Each curved section 45 has the configuration of a cylindrical arc and in this embodiment, there are four arc-shaped sections 45 though more or less than this number may be used. On the underside of the sections 45, at each lengthwise end thereof, is a lip 45*a* which engages with a complementary part on the end cap 20 or the end piece 22. As shown in FIG. 2, the end cap 20 has an annular recess 20*b* on its inner side for receiving therein the lips 45*a* which are provided at one end of the arc-shaped sections 45, and the end piece 22 has an annular lip 22*a* on its inner side for receiving thereunder the lips 45*a* which are provided at the other end of the sections 45. The arc-shaped sections 45 are interconnected in side-by-side relation by upper lips 45*b* extending lengthwise along one widthwise side thereof and lower lips 45*c* extending lengthwise along the other widthwise side therof. The upper and lower lips 45*b* and 456*c* of one section 45 mate or engage with the lower and upper lips 45*c* and 45*b*, respectively, of the two adjoining sections 45. A bonding agent may also be used to fix together as a unit the end cap 20, end piece 22 and arc-shaped sections 45.

The elongated bristle supports 30 each include a row of bristles 16 which are arranged to align with respective ones of the bristle apertures 14 provided in the outer tubular member 18 of the brush. A retractable hair brush having this type of bristle configuration is particularly suitable for use as a hair curling brush or as an attachment for a hair drying device. As shown, each bristle 16 is aligned with and slidably extendable through commensurately dimensioned apertures 14 in the outer tubular member 18 of the brush 10. The bristle apertures 14 may be dimensioned to permit only the passage of the bristles 16 therethrough such that retraction of the bristles 16 dislodges hair and other debris which may become entangled around the bristles 16. Alternatively, the apertures 14 may be provided with wiping blades (not shown) which permit only the bristles to pass therethrough and which prevent hair and other debris from entering into the housing 12.

The alignment of the bristles 16 with the bristle apertures 14 can be maintained by ensuring that when the bristles 16 are fully retracted, the tips of the bristles 16 are always within the apertures 14 of the outer tubular member 18. This may be accomplished by appropriate dimensioning of any one or more of the bristles 16, the inner tubular member 24, the flanges 26, the openings 28, and the outer tubular member 18. Moreover, in order to prevent jamming of the bristles 16, enlarged tips 16*a* are provided on the ends of the respective bristles 16 to prevent the bristles from being inadvertently or accidently dislocated with respect to the apertures 14 when the bristles 16 are in a retracted position.

As will be appreciated, the relative dimensions of the foregoing elements may be varied to obtain a brush with the desired size. For example, the brush diameter may be reduced by reducing the diameter of the inner and outer tubular members 24, 18, so long as the dimensions are adequate for proper alignment of the bristles 16 with the bristle apertures 14 in the extended and retracted positions of the bristles 16. Alternatively, the inner tubular member 24 may be reduced in diameter to permit the use of longer bristles 16. The number of bristle supports 30 that may be provided, and hence the number of rows of bristles, is dependent on the diameter of the respective bristle supports 30 and the inner tubular member 24. Thus, by reducing the diameter of the bristle supports 30, a larger number of bristle supports 30 may be accommodated in suitably dimensioned openings 28 provided in the flanges 26. Similarly, the number of bristles 16 can be increased or decreased, as desired, to achieve a desired effect.

A locking mechanism is provided to maintain the bristles 16 in their extended and retracted positions. In the disclosed embodiment, the locking mechanism comprises two recesses 46 formed in the end piece 22 and a detent carried by the actuator 38 and engageable in one or the other of the recesses. The recesses may have a partly spherical shape, and the detent may be in the form of a locking ball 48 housed in the actuator 38 and biased by a spring 50 towards the end piece 22. The recesses 46 are disposed in angularly spaced relation along the path of travel of the spring-biased locking ball 48 so that when the actuator 38 has been angularly displaced by an amount at which the bristles 16 are fully extended or fully retracted, the locking ball 48 engages in one of the recesses 46 to thereby releasably lock the bristles in position. Other locking means, such as a friction lock or the like, may also be employed instead of the ball-and-recess mechanism.

The inner tubular member 24 is disposed to undergo angular displacement in opposite directions within the outer tubular member 18 so that the bristles 16 are extendable through the bristle apertures 14 in the outer tubular member 18 and lockable in the fully extended position when the locking ball 48 becomes engaged in the corresponding recess 46 formed in the end piece 22 by means of the spring 50, and are retractable through the bristle apertures 14 and lockable in the fully retracted position when the locking ball 48 becomes engaged in the other recess 46 for the purpose of cleaning the brush, reducing the size of the brush for storage purposes, or preventing the bristles 16 from becoming entangled in the hair.

During use, in order to accomplish extension and retraction of the bristles 16, the user grasps the handle grip portion 36 and using one finger, typically the thumb, turns the actuator 38 in a given direction. Since the actuator 38 is connected to turn with the inner tubular member through the projection-and-slot connection 41,42, the inner tubular member 24 undergoes angular displacement in the same direction as the actuator 38. For example, when the actuator 38 is turned clockwise CW in FIG. 1, the bristles are extended and when the actuator is turned counterclockwise CCW, the bristles are retracted.

Figure 5:
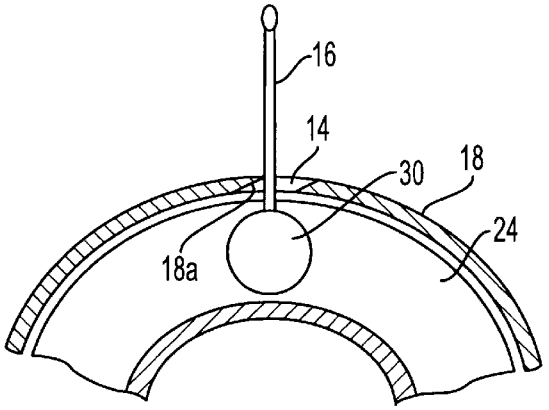
FIGS. 5–7 are explanatory diagrams for explaining the manner in which the bristles extend and retract in the brush of the present invention.
Figure 6:
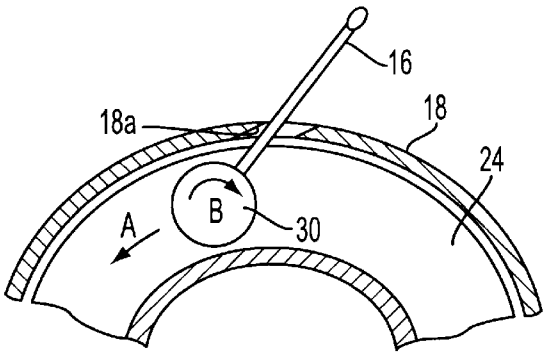
Figure 7:
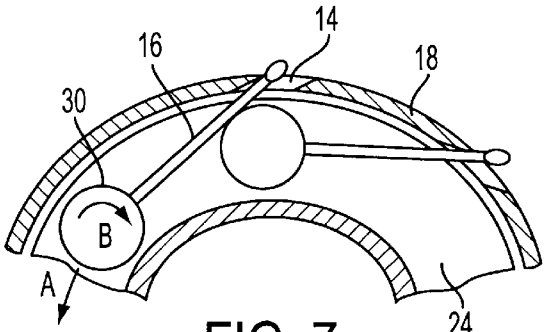

FIGS. 5–7 illustrate the coaction among the inner and outer tubular members 24 and 18, the bristle supports 30 and the bristles 16 during a bristle retraction operation. FIG. 5 illustrates the bristles 16 at a fully extended position. When the actuator 38 is turned in a counterclockwise direction indicated by an arrow A in FIGS. 6 and 7, the bristles 16 are driven toward sidewalls 18*a* of the respective apertures 14 which, in turn, causes turning of the bristle supports 30 in a clockwise direction indicated by an arrow B. Continued turning of the inner tubular member 24 in the counterclockwise direction A causes the bristle supports 30 to undergo angular displacement in the clockwise direction B within the openings 28 to cause the bristles 16 to retract through the bristle apertures 14.

The bristle apertures 14 are dimensioned to permit only the passage of the bristles 16 therethrough so that retraction of the bristles 16 dislodges hair and other debris which may have become lodged around the bristles 16. When the bristles 16 are fully retracted, the tips 16*a* of the bristles 16 remain within the bristle apertures 14 so as to maintain the alignment of the bristles 16 with the apertures 14.

Turning of the actuator 38 in the opposite direction causes the bristles to be extended in the same manner as described above.

According to the present invention, the means to actuate the inner tubular member 24 so that the bristles 16 are extendable from the outer tubular member 18 and lockable in that position and the means to withdraw the bristles 16 in relation to the outer tubular member 18 are located conveniently where the handle 34 joins the brush body 12 such that actuation of same can be readily effected by the same hand or finger by which the user holds the brush. In addition, by providing a locking means which does not require manual operation, extension and retraction of the bristles 16 can be accomplished in a one-step operation.

The inner and outer tubular members 24, 18 and the other structural parts of the brush may be formed of any suitable material, such as an injection moldable plastic, for example, polyethylene, polypropylene, or the like, or may be formed of other materials, such as wood, metal, or any other material suitable for a particular application. For instance, when configured as a hair brush, a plastic material having sufficient rigidity is preferably used. However, when configured as a brush attachment for an appliance such as a hair dryer or hair curler, selection of materials is somewhat dependent on the quantity of heat energy generated by the appliance. In the case of a hair curler, for example, the outer tubular member should be formed of a material capable of a high degree of heat transfer so that heat produced within the cylindrical brush housing 12 may be conveyed to the hair user's to set a curl. In that case, the bristles and the inner tubular member and associated internal components of the brush which are exposed to intense heat produced by an internal heating element should be formed of a material having sufficient heat transfer characteristics and heat resistance.

Bristles of any suitable type may be employed. Thus, the bristles 16 may be of the tufted type, arranged in tufts each containing a plurality of bristles and mounted on the bristle supports 30. However, in the preferred embodiment, the bristles 16 are of the individual or single type, which may be molded in one piece with the bristle support 30 from a suitable flexible material, such as polyethylene or polypropylene plastic material, or the like.

Figure 8:
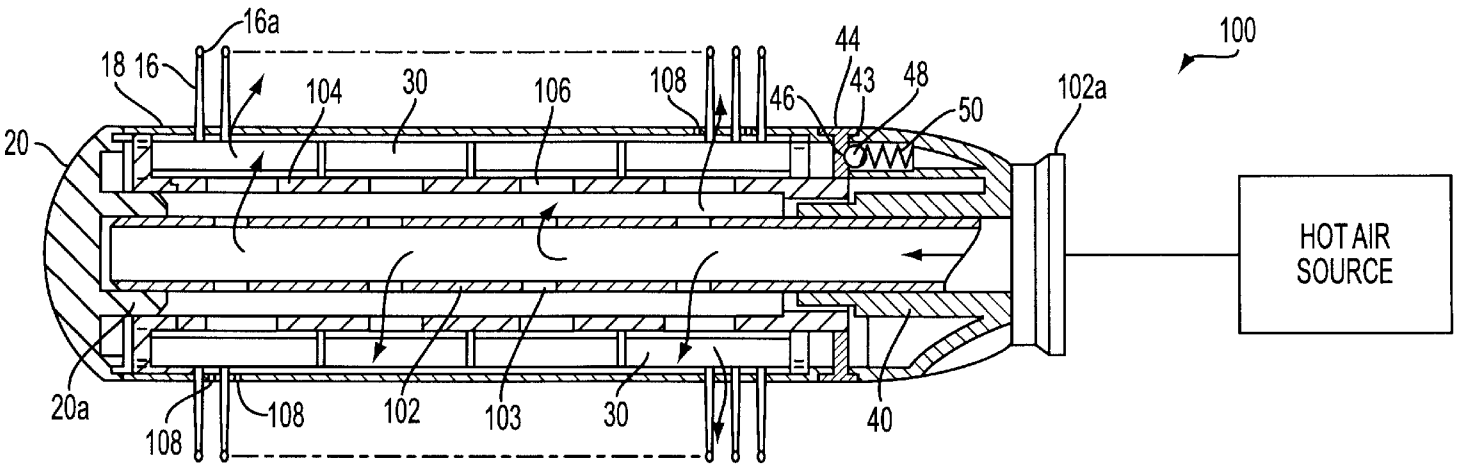
FIG. 8 is a side elevational view of a styling brush attachment for a hair dryer in accordance with a second preferred embodiment of the present invention.

With reference to FIG. 8, a second preferred embodiment of the present invention is illustrated by way of example. Reference numeral 100 designates a retractable brush attachment for a hot air blow dryer (not shown). For ease of discussion, elements which are the same or similar to those shown in FIGS. 1–4 are indicated by the same reference numerals, and a detailed description thereof is omitted.

In this embodiment, the handle 34 is replaced with a tubular connecting member 102 which extends lengthwise through the inner tubular member 104. One end of the connecting member 102 is fixed to the hub 20*a* of the end cap 20 and the other end thereof projects axially outwardly beyond the actuator 38 and terminates in an adapter or fitting 102*a* configured and dimensioned to releasably attach to the outlet end of a conventional hot air blow dryer. Heated air produced by the blow dryer is conveyed axially through the tubular connecting member 102 and discharged radially outwardly through holes 103 formed in the wall of the connecting member and through a plurality of circumferentially extending holes in the shape of slots 106 provided in the wall of the inner tubular member 104 to convey the hot air from the center of the housing 12 to the area between the inner and outer tubular members 104 and 18. The hot air flows around the bristle supports 30 and is ejected through the bristle apertures 14 to dry the hair.

As should be recognized, the holes or slots 106 need not extend circumferentially in the inner tubular member 104 and can instead extend lengthwise therein. In addition, holes or slots 108 may also be formed in the wall of the outer tubular member 18 to produce a more uniform flow of heated air.

As should also be recognized, although the device 100 is illustrated as an attachment for a hand-held hot air blow dryer, it may instead be formed integrally with a blow dryer for styling and curling purposes.

Figure 9:
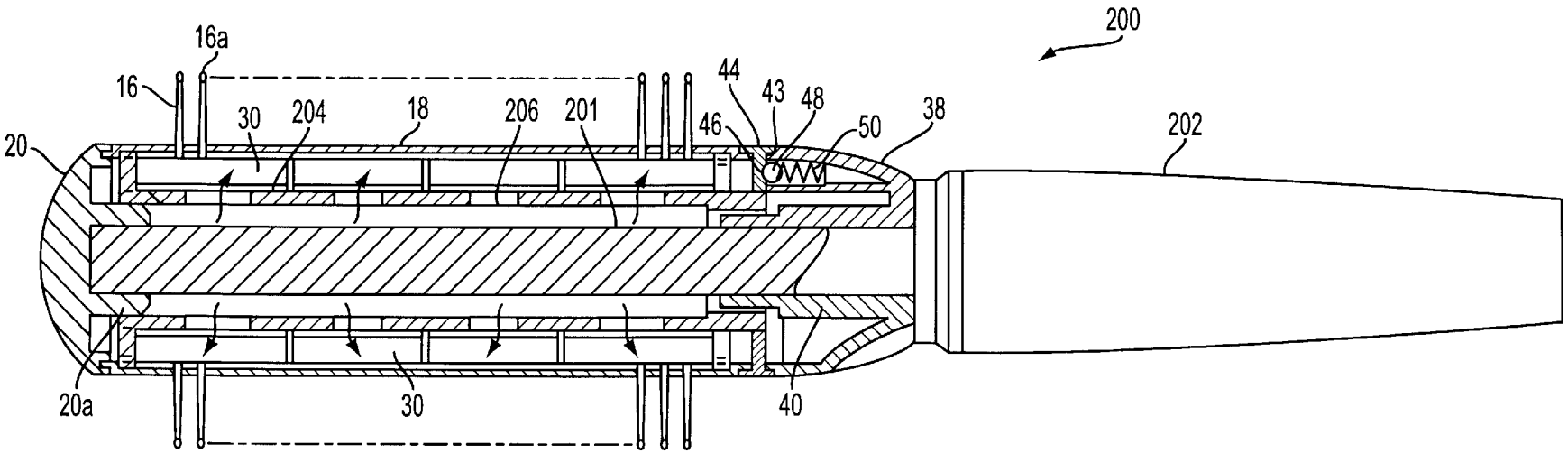
FIG. 9 is a side elevational view of a hair curling appliance in accordance with a third embodiment of the present invention.

It is also within the scope of the present invention to form the brush with an internal heating element supported in the central chamber of the inner tubular member, in which case the brush would be effective as a heated hair curler. FIG. 9 illustrates a hair curling appliance 200 in accordance with this aspect of the invention. For ease of discussion, elements in FIG. 9 which are the same or similar to those shown in FIGS. 1–4 are identified by the same reference numerals, and a detailed description thereof is omitted.

In this embodiment, the internal components of the brush, including the inner and outer tubular members 204 and 18, the bristle supports 30 and the actuator 38 are formed of a material having suitable heat resistance to prevent melting. Preferably, the outer tubular member 18 is formed of a material having heat transfer characteristics, such as a metal, adequate to transfer heat produced by the heating element to the user's hair.

A handle 202 houses an electrical device connectable by a power cord and an ON/OFF switch (not shown) to a source of electric power for driving a heating element 201 disposed in the center of the inner tubular member 204. The heating element 201 preferably comprises a heating resistor which, when energized, produces sufficient heat energy to style or curl the user's hair. The inner tubular member 204 is provided with holes in the shape of slots 206 extending in a circumferential and/or a lengthwise direction thereof to permit heat energy generated by the heating element 201 to flow radially outwardly to heat the outer tubular member 18 to thereby heat the user's hair during styling or curling.

Various aspects of the present invention have been described by way of example only and it will be appreciated that numerous modifications and additions thereto may be made without departing from the spirit or scope thereof as defined in the appended claims.

What is claimed is:

1. A retractable brush comprising: an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted with a snap-fit on the respective flanges to undergo angular displacement in forward and reverse directions to effect extension and retraction of the bristles through the bristle apertures of the outer tubular member in response to angular displacement of the inner tubular member; a handle connected to the outer tubular member for grasping by a hand of a user of the brush; and an actuator manually turnably mounted on the handle and connected to the inner tubular member to effect angular displacement of the inner tubular member in opposite directions to extend and retract the bristles in response to manual turning of the actuator by the user of the brush.

2. A retractable brush comprising an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member; a handle connected to the outer tubular member for grasping by a hand of a user of the brush, the handle having an extension extending lengthwise through the inner tubular member; an end cap having a center portion connected to one end of the handle and a peripheral portion connected to one end of the outer tubular member; and an actuator manually turnably mounted on the handle and connected to the inner tubular member to effect angular displacement of the inner tubular member in opposite directions to extend and retract the bristles in response to manual turning of the actuator by the user of the brush.

3. A retractable brush according to claim 2; including an end piece connected to the other end of the outer tubular member and being turnably mounted on the inner tubular member.

4. A retractable brush according to claim 3; including locking means for releasably locking the bristles in extended and retracted positions.

5. A retractable brush according to claim 4; wherein the locking means comprises one part on the actuator engageable with another part on the end piece.

6. A retractable brush according to claim 4; wherein the locking means comprises a pair of recesses formed in one of the end piece and the actuator at locations corresponding to fully extended and full retracted positions of the bristles, and a detent carried by the other one of the end piece and the actuator and releasably engageable in alternate ones of the recesses to releasably lock the bristles in the fully extended and fully retracted positions.

7. A retractable brush according to claim 6; wherein the detent comprises a spring-biased locking ball.

8. A retractable brush according to claim 3; wherein the outer tubular member has a lip at each lengthwise end thereof engageable with a complementary part on the end cap or the end piece.

9. A retractable brush according to claim 8; wherein the outer tubular member comprises a plurality of arc-shaped sections interconnected together in side-by-side relation to constitute the outer tubular member.

10. A retractable brush according to claim 9; wherein each arc-shaped section has a lip at each lengthwise end thereof.

11. A retractable brush comprising: an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member; a handle connected to the outer tubular member for grasping by a hand of a user of the brush; an actuator manually turnably mounted on the handle and connected to the inner tubular member to effect angular displacement of the inner tubular member in opposite directions to extend and retract the bristles in response to manual turning of the actuator by the user of the brush; and a locking mechanism for releasably locking the inner tubular member, relative to the outer tubular member, in angular positions corresponding to full extension and full retraction of the bristles, the locking mechanism comprising a spring-biased detent carried by the actuator to undergo movement along an angular path of travel in response to turning of the actuator, and means defining two recesses fixed relative to the outer tubular member and disposed in angularly spaced relation along the path of travel of the detent, the two recesses being located at positions corresponding to full extension and full retraction of the bristles, respectively, and the spring-biased detent being engageable in alternate ones of the two recesses to releasably lock the bristles in fully extended and fully retracted positions.

12. A retractable brush comprising: an outer tubular member having a pattern of bristle apertures, the outer tubular member comprising a plurality of arc-shaped sections interconnected together in side-by-side relation to constitute the outer tubular member; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member; a handle connected to the outer tubular member for grasping by a hand of a user of the brush; and an actuator manually turnable mounted on the handle and connected to the inner tubular member to effect angular displacement of the inner tubular member in opposite directions to extend and retract the bristles in response to manual turning of the actuator by the user of the brush.

13. A retractable brush according to claim 12; wherein the arc-shaped sections have upper lips extending lengthwise along one widthwise side thereof and lower lips extending lengthwise along the other widthwise side thereof, the upper and lower lips of each section mating with lower and upper lips, respectively, of adjoining sections.

14. A retractable brush comprising: an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges, each flange having circumferentially spaced-apart openings; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member, the openings of at least one flange being configured to receive therein with a snap fit one of the ends of the bristle supports while permitting the bristle supports to turn freely within the openings; a handle connected to the outer tubular member for grasping by a hand of a user of the brush; and an actuator manually turnably mounted on the handle and connected to the inner tubular member to effect angular displacement of the inner tubular member in opposite directions to extend and retract the bristles in response to manual turning of the actuator by the user of the brush.

15. A retractable brush according to claim 14; wherein the openings of at least one flange have a region of partly circular shape and a region of radially outwardly diverging shape, the interface between the two regions being slightly smaller than the diameter of the end of the bristle supports mounted in the openings.

16. A retractable brush comprising: an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member, and the bristle supports having axially spaced and circumferentially extending ribs which ride on the outer surface of the inner tubular member to prevent inward bowing of the bristle supports during use of the brush; a handle connected to the outer tubular member for grasping by a hand of a user of the brush; and an actuator manually turnably mounted on the handle and connected to the inner tubular member to effect angular displacement of the inner tubular member in opposite directions to extend and retract the bristles in response to manual turning of the actuator by the user of the brush.

17. A retractable brush for use with a hot air blow dryer, the retractable brush comprising: an outer tubular member having a pattern of bristle apertures; an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member; a tubular connecting member extending lengthwise within the inner tubular member and being connectable at one end to a source of heated air, the tubular connecting member and the inner tubular member having holes through the walls thereof for discharging heated air from within the tubular connecting member radially outwardly through the bristle apertures; and an actuator manually turnably mounted on the tubular connecting member and connected to the inner tubular member to effect angular displacement of the inner tubular member in opposite directions to extend and retract the bristles in response to manual turning of the actuator by the user of the brush.

18. A retractable hair curling appliance comprising: an outer tubular member having a pattern of bristle apertures;

an inner tubular member extending lengthwise within the outer tubular member and being mounted to undergo angular displacement in opposite directions within the outer tubular member, the inner tubular member having a pair of axially spaced flanges; a plurality of bristle supports each extending lengthwise within the outer tubular member and supporting a series of bristles, the bristle supports having opposite end portions mounted on the respective flanges to undergo angular displacement in forward and reverse directions to effect extension and retraction of the bristles through the bristle apertures of the outer tubular member in response to angular displacement of the inner tubular member; a handle connected to the outer tubular member for grasping by a hand of a user of the hair curling appliance; a heating element connected to the handle and extending lengthwise within the inner tubular member, the inner tubular member having holes in the wall thereof for permitting heat energy produced by the heating element to flow radially outwardly through the bristle apertures; and an actuator manually turnable relative to the outer tubular member and connected to the inner tubular member to effect angular displacement of the inner tubular member in opposite directions to extend and retract the bristles in response to manual turning of the actuator by the user of the hair curling appliance.

* * * * *